US005540326A

United States Patent [19]

Arnold et al.

[11] Patent Number: 5,540,326

[45] Date of Patent: Jul. 30, 1996

[54] TWO-COMPONENT PACKAGES

[75] Inventors: Peter S. Arnold, Skipton; Kevin Hilton, Lower Deleval; Nina Warburton, Newbiggin by the Sea; Brian Wilson, Newcastle-upon-Tyne, all of United Kingdom

[73] Assignee: Johnson & Johnson Medical, Inc., Arlington, Tex.

[21] Appl. No.: 418,320

[22] Filed: Apr. 7, 1995

[30] Foreign Application Priority Data

Apr. 7, 1994 [GB] Great Britain ..... 9406880

[51] Int. Cl.[6] ..... B65D 25/08

[52] U.S. Cl. ..... 206/221; 215/DIG. 8

[58] Field of Search ..... 206/219, 220, 206/221; 215/6, 228, DIG. 8

[56] References Cited

U.S. PATENT DOCUMENTS

| | | | |
|---|---|---|---|
| 4,024,952 | 5/1977 | Leitz . | |
| 4,195,730 | 4/1980 | Hunt . | |
| 4,386,696 | 6/1983 | Goncalves . | |
| 4,793,475 | 12/1988 | Itzel . | |
| 4,823,946 | 4/1989 | Stoeffles et al. | 206/221 |
| 4,903,828 | 2/1990 | Finke et al. . | |
| 5,277,303 | 1/1994 | Goyet et al. | 206/221 |

FOREIGN PATENT DOCUMENTS

| | | |
|---|---|---|
| 0251193 | 1/1988 | European Pat. Off. . |
| A-2544328 | 4/1976 | Germany . |
| U-8624484 | 1/1988 | Germany . |

OTHER PUBLICATIONS

Search Report in GB 95302307.4, a corresponding foreign application dated Jul. 10, 1995.

Derwent WPI, Abstract of GB–A–2,220,930, Originally Published Jan. 24, 1990.

Search Report in GB 9406880.6, a corresponding foreign application dated Jun. 8, 1994.

*Primary Examiner*—Jacob K. Ackun

[57] ABSTRACT

Two-component packages for storing two components which are to be isolated from each other during storage and mixed when the package is opened. The packages comprise an outer container (2) for a first component having a threaded neck (3). A closure cap (5) is provided to close the threaded neck (3). A capsule (6) for a second component is located inside the outer container (2) and extends into the threaded neck (3) of the outer container (2). A first ratchet means extends downwardly from the base of the closure cap (5) and engages with a second ratchet means on the top part (7) of the capsule (6), whereby the closure cap (5) can be screwed down without rotating the said top part (7) of the capsule (6), but cannot readily be unscrewed without also rotating the said top part (7). A rotation block (13,14) prevents rotation of a lower part (11) of the capsule (6). As a result, unscrewing the closure cap (5) exerts a torsional force on the capsule (6). Release means (12), such as a screw thread, are provided in the capsule (6) to release the contents of the capsule (6) when the said torsional force is applied.

16 Claims, 3 Drawing Sheets

TWO-COMPONENT PACKAGES

The present invention relates to two-component packages for storing two components which are to be isolated from each other during storage and mixed when the package is opened.

Two-component packages of the above type have a number of applications. For example, it may sometimes be desirable to store a concentrated active ingredient, such as a pesticide, separately from a diluent, with mixing taking place only when the package is opened immediately prior to use. In the disinfectant art it is frequently necessary to add concentrated acid to activate a disinfectant solution, such as a sodium hypochlorite solution, immediately prior to use. This is because the activated solution itself cannot be stored for long periods because of gas evolution and loss of disinfectant power. Accordingly, it is necessary to store the disinfectant solution and the concentrated acid separately in a two-component package, with mixing taking place when the package is opened.

The concentrated active ingredients and concentrated acids referred to above are potentially harmful to humans, and accordingly the two-component package should preferably be designed so that mixing takes place automatically when the package is opened without requiring any manipulation of the concentrates by the user. Preferably, the two-component packages should be designed so as to make it difficult to remove the concentrate from the package without first mixing it with the diluent, so that the user has minimum risk of contact with the undiluted concentrate. Preferably, the two-component packages should comprise a secondary container for the concentrate that is entirely enclosed within a primary container for the diluent. In this way, any accidental failure of the secondary container is contained by the primary container.

GB-A-1567394 describes a two-component package in which the components are mixed automatically when the cap of the package is removed. The package comprises a first container having a neck and a body for receiving a first component, such as a diluent. A closure cap is fitted to the neck, e.g. by threading, to close the first container. A mounting skirt extends from the base of the closure cap into the neck of the first container to define a part of a second container for receiving a second component. A removable cup is attached to the mounting skirt to complete the second container and to close it off from the first container. A resilient flange is carried by the closure cap or the removable cup in a position such that it is below the neck of the container in the assembled configuration, the flange being configured to collapse radially to allow insertion into the neck of the first container, but not to collapse radially when being pulled out of the first container. As a result, when the closure cap is moved outwardly from the sealing position on the neck of the first container (e.g. by unscrewing the threaded cap), the flange comes into abutment against the inner end of the neck of the first container and causes separation of the removable cup from the mounting skirt, thereby releasing the second component into the first container. Typically, the first component is a diluent and the second component is a concentrate.

EP-A-0190593 describes two-component packaging systems comprising a bottle having a threaded neck and a closure cap containing a reservoir intended to receive a concentrate, where the closure cap is rotatable on the neck of the bottle and has a collar extending radially into the bottle neck from the base of the closure cap, and the collar is arranged, by means of a collar thread, to receive an inner container containing the concentrate; and either:

between the outer wall of the inner container and the inner wall of the bottle neck a rotation block is provided at one or more points which prevents free rotation of the inner container in one or both directions of rotation; or:

the collar is angular or pointed in construction to form an abutment edge at its lower end and rests on the base or on an annular step extending about a divisible internal container in such a way that when the inner container screwed onto the collar thread is rotated further in the direction of closure of the collar thread, the inner container is severed along the weakened line, while either (a) the free rotation of the inner container is impeded in one or both directions by one or more rotation blocks mounted on the outer wall of the inner container and on the inner wall of the bottle neck, or (b) the inner container comprises, on its upper portion, an annular bead which is directed radially outwardly and abuts on the bottle neck, this annular bead defining the depth of suspension of the inner container and possibly blocking the free rotation of the inner container by means of knobs or notches.

The above two-component packaging systems provide the advantage that a secondary container for receiving a concentrate is located substantially inside the primary container for the diluent. Simply removing the cap from the neck of the primary container automatically releases the concentrate into the diluent, ready for use. The concentrate cannot easily be removed from the package in undiluted form.

However, the above two-component packages suffer from significant drawbacks. The principal drawback is that the closure cap forms an integral part of the secondary container for receiving the concentrate. In each case the secondary container is formed by fitting a cup to a collar or skirt extending downwardly from the base of the closure cap. In practice, it is very difficult to prevent leakage of the concentrate from secondary containers formed in this way. The problem of leakage from secondary containers formed in this way is addressed, for example, in EP-A- 0235806. Furthermore, it is likely that traces of concentrate will remain on the inside of the cap after the cap has been removed, and these traces of concentrate are potentially hazardous to the user. Moreover, the material of the cap may not be fully compatible with both the concentrate inside the secondary container and with the material making up the other portion of the secondary container.

A further difficulty with the two-component packages described in EP-A-0190593 is that the closure caps described therein cannot be made by conventional injection moulding. Either expensive, divisible injection moulding tools have to be used, or the closure caps must be made in two parts that are snap-fitted together.

Accordingly, it is an object of the present invention to provide improved two-component packages that do not suffer from the above drawbacks of the existing art.

The present invention provides a two-component package for storing two components which are to be isolated from each other during storage and mixed when the package is opened, the package comprising:

a container to receive a first component, said container having a threaded neck;

a threaded closure cap to close the threaded neck of the container;

a capsule to receive a second component, said capsule being located inside the container with an upper part of the capsule extending into the threaded neck of the container;

a first ratchet means extending inwardly from the closure cap;

a second ratchet means extending from the upper part of the capsule to engage the first ratchet means, whereby the closure cap can be screwed down without rotating the upper part of the capsule, but unscrewing the closure cap causes the top part of the capsule to rotate with the closure cap;

one or more rotation blocks provided on the outer wall of the capsule and on the inner wall of the container to impede rotation of a lower part of the capsule in the direction of unscrewing of the closure cap; and release means provided on the capsule to release the second component from the capsule when the upper part of the capsule is rotated relative to the lower part of the capsule.

The container may be provided with further apertures for filling or emptying, in addition to the threaded neck. However, preferably, the threaded neck is the sole aperture into the container. This ensures that the container cannot be opened without simultaneously releasing the contents of the capsule into the contents of the container. The threaded neck may be provided with single-start or multi-start threading.

The threaded closure cap may be provided with single-start or multi-start threads. Preferably, the mouth of the cap is provided with a sealing lip to abut against the outer surface of the container. The closure cap may also be provided with an integral tamper-evident band. Preferably, the closure cap is injection moulded from thermoplastic material. Since the closure cap does not form part of the capsule for receiving the concentrated second component, the material of the closure cap can be selected to optimise its sealing behaviour rather than its chemical resistance.

The capsule to receive the second component (normally a concentrated second component) is entirely, or almost entirely, enclosed within the container. The capsule is preferably formed, filled and sealed separately from the container and then introduced into the container. Preferably, the upper part of the capsule is provided with a threaded aperture for filling the capsule, and the threaded aperture is closed by a capsule closure cap.

Preferably, the capsule is provided with snap-fitting means to secure the capsule to complementary receiving means provided on the inside of the container. The snap-fitting means secure the capsule in a longitudinally fixed position with the upper part of the capsule extending into the threaded neck of the container. The snap-fitting means may be attached either to the body of the capsule or to the capsule closure cap. In preferred embodiments, the snap-fitting means comprise a plurality of radially compressible fins extending from the body of the capsule. The radially compressible fins are normally flexible thermoplastic fins that can flex inwardly towards the longitudinal axis of the capsule. The fins may flex about a vertical axis, in which case the fins are preferably arranged tangentially to a circle drawn about the longitudinal axis of the capsule. Alternatively, the fins may flex about a horizontal axis. The fins can be compressed to introduce the capsule into the container, and then spring out resiliently to engage the complementary receiving means on the inside of the container. For example, the complementary receiving means may comprise a flange on the inside of the neck of the container. In that case, the flange preferably engages a notch provided on a leading edge of radially compressible fins on the capsule. Alternatively, the leading edge of the fins may engage in a recess provided in the inside of the neck of the container.

The first and second ratchet means may be any complementary ratchet means such that rotation of the closure cap in the opening direction necessarily causes rotation of the top part of the capsule, whilst rotation of the closure cap in the closure direction exerts little or no rotational force on the top part of the capsule in that direction. Preferably, the first ratchet means comprises one or more drive pegs extending downwardly from the base of the closure cap and the second ratchet means comprises one or more ribs extending upwardly from the upper part of the capsule, one or both of the said drive pegs and said ribs being flexible. In other preferred embodiments, the first ratchet means comprises a collar extending downwardly from the base of the closure cap with one or more abutment means provided around the inner or outer circumference of the collar, and the second ratchet means comprises a cylinder on the top of the capsule, said cylinder fitting into or around the collar and said cylinder being provided with one or more abutment means around its outer or inner circumference, at least one of said first and second abutment means being flexible. In yet other preferred embodiments, the first ratchet means comprises drive ribs projecting inwardly from the side wall of the closure cap and the second ratchet means comprises one or more capsule ribs projecting upwardly from the upper part of the capsule, at least one of said drive ribs and capsule ribs being flexible.

The second ratchet means may be attached to the body of the capsule, or may be attached to the capsule closure cap. In the latter case the direction of unscrewing of the capsule closure cap is generally opposite to the direction of unscrewing of the container closure cap, so that unscrewing the container closure cap does not simply unscrew the capsule closure cap at the same time, but instead provides the torsional force needed to activate the release means.

The rotation blocks may comprise any means that impede rotation of the lower part of the capsule in the direction of unscrewing of the closure cap. The terms "outer wall" and "inner wall" include the respective bases of the capsule and the container in addition to their side walls. Preferably, a flange is provided around the base of the capsule that abuts against one or more ribs projecting inwardly from the side wall of the container. Alternatively, a rib or tongue may project from the lower part of the capsule and engage in a corresponding recess provided in the inside wall of the container. In other embodiments, the lower part of the capsule may be of non-circular cross-section and be blocked from rotation by engagement with a correspondingly shaped inner walls of the container. In yet other preferred embodiments, a slot recess is provided in the base of the capsule that engages a key projection on the inside of the base of the container.

The release means may be any means that causes the second component to be released from the capsule when the upper part of the capsule is rotated relative to the lower part of the capsule, i.e. when a torsional force is applied to the capsule. For example, the release means may comprise a line of weakness formed in the wall of the capsule, preferably a helical line of weakness formed in the side wall of the capsule. More preferably, the release means comprises a screw thread joining the upper and lower parts of the capsule. The screw thread has the same directionality as the screw thread closing the neck of the container, whereby the screw thread on the capsule is unscrewed by rotation of the top part of the capsule in the direction of opening of the closure cap. Preferably, the screw thread includes further sealing means, such as sealant compounds or a gasket, to prevent leakage of the second component from the capsule through the screw thread. Also preferably, the capsule further comprises a loaded biasing means to drive the upper and lower parts of the capsule apart after the release means has been activated. Preferably, the loaded biasing means comprises a coil spring substantially concentric with the longitudinal axis of the capsule.

It is sometimes the case that the concentrate, such as a concentrated acid, stored in the capsule evolves gas on storage. In order to prevent a dangerous build-up of pressure inside the capsule, it is desirable to vent the gas out of the capsule. This venting should be achieved without also allowing any of the concentrate to escape from the capsule. Preferably, the venting is achieved by providing the capsule with a gas venting means comprising an aperture covered by a semipermeable membrane. The term "semipermeable membrane" encompasses all membranes that allow the passage of gas whilst blocking the passage of the liquid or solid concentrate held in the capsule. Typically, the membrane will be a microporous membrane (e.g. a pore size of 50 μm or less) formed from a hydrophobic polymer such as polyethylene or polytetrafluoroethylene. Such a membrane will block the passage of aqueous concentrates, such as concentrated acids, out of the capsule.

The aperture covered by the semipermeable membrane may simply be the threaded aperture in the upper part of the capsule that is used to fill the capsule. The membrane is then held in place by screwing down the capsule closure cap, which is provided with a hole in its base to allow the passage of gases vented through the semipermeable membrane. Preferably, the semipermeable membrane covers an aperture at the end of a flexible venting tube extending into the capsule. The flexible tube is provided with flotation means, such as a float near the end of the tube. The flotation means tends to lift the end of the tube into the gas-filled space above the surface of the concentrate whatever the orientation of the capsule, and this results in more efficient gas venting, particularly where the concentrate is a liquid concentrate. More preferably, the flexible tube is branched and the aperture at the end of each branch is covered by a semipermeable membrane. This helps to ensure that one of the apertures is always in the gas-filled space above the concentrate, whatever the orientation of the capsule.

Specific embodiments of the invention will now be described further, by way of example with reference to the accompanying drawings, in which.

Figure 1:
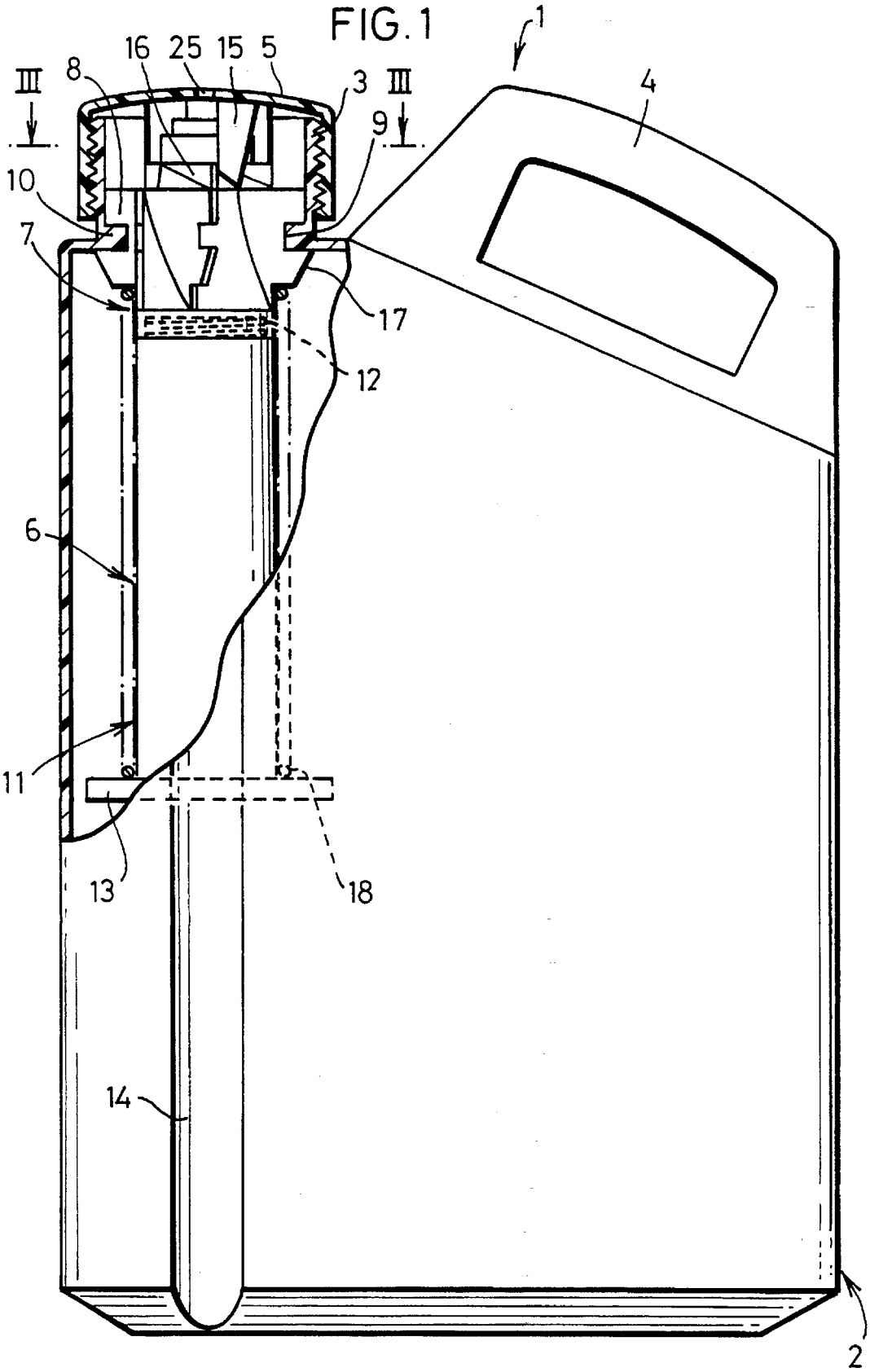
FIG. 1 shows a partially cut-away side elevation view of a two-component package according to the present invention.
Figure 2:
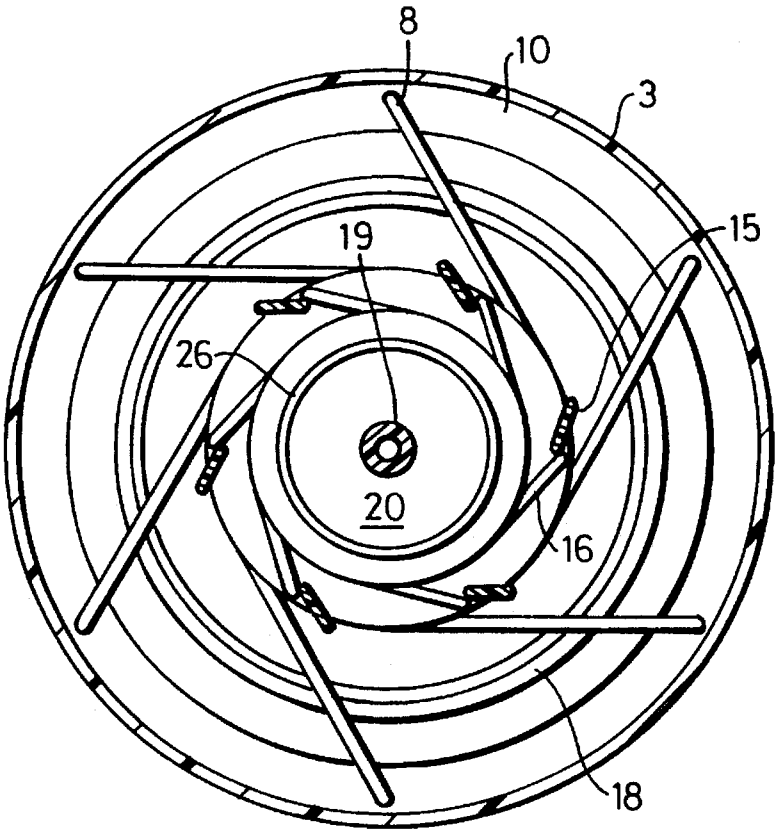
FIG. 2 shows a horizontal sectional plan view through II of FIG. 1 to illustrate the first and second ratchet means of the two-component package.

Referring to FIGS. 1 and 2, the two-component package (1) comprises the container (2) having a threaded neck (3) and handle (4), all formed in one piece from blow-moulded thermoplastic. A threaded closure cap (5) of injection-moulded thermoplastic forms a tight seal over the threaded neck (3) of the container (2).

Inside the container (2) there is located a capsule (6), an upper part (7) of which extends into the neck (3) of the container (2). The capsule (6) is held in place by means of radially extending flexible fins (8) on the capsule (6). The flexible fins extend tangentially to a circle drawn about the longitudinal axis of the capsule. The flexible fins (8) have a notch (9) on their leading edge that engages with an interior flange (10) extending around the inside of the neck (3) of the container (2). A lower part (17) of each flexible fin (8) is bevelled.

The capsule (6) is formed in two-parts from injection-moulded thermoplastic material. The upper part (7) and lower part (11) are joined together by means of a screw thread (12), which is sealed to prevent any leakage of the contents of the capsule (6) during storage. The lower part (11) of the capsule (6) is provided with a flange (13) around its base that abuts against a rib (14) on the inside surface of the container (2) to block rotation of the lower part (11) of the capsule (6). A coil spring (18) is wrapped in compression around the capsule (6) and abuts against the flexible fins (8) and the flange (13).

A threaded aperture (26) is provided at the top of the capsule (6) for filling the capsule (6) and venting of gases. Into the threaded aperture (26) there is inserted a flexible tube (19) having a flange (20) at one end that rests on the lip of the threaded aperture (26). The other end of the flexible tube (19) is located inside the capsule (6) and is covered by a semipermeable microporous hydrophobic membrane (21) and provided with a float (22) to raise it to the surface of any liquid inside the capsule (6). A capsule closure cap (23) is screwed down onto the threaded aperture (26) to provide a liquid-tight seal on the capsule. A nozzle (24) for venting gases extends upwardly from the capsule closure cap and through a hole (25) in the centre of the main closure cap (5). A seal is formed between the nozzle (24) and the hole (25) in the centre of the main closure cap in order to ensure that none of the contents of the container can leak out of the hole (25) during storage.

First ratchet means are provided on the threaded closure cap (5) in the form of flexible drive pegs (15) extending downwardly from the base of the closure cap (5). The drive pegs (15) are fin-shaped and oriented tangentially to a circle drawn about the axis of rotation of the closure cap. Second ratchet means are provided on the top part (7) of the capsule (6) in the form of ribs (16) extending upwardly from the capsule (6). The ribs (16) are oriented tangentially to a circle drawn about the longitudinal axis of the capsule.

The two-component package is assembled as follows. First, the first component to be packaged (usually a diluent) is introduced into the container (2). Then the capsule is filled through threaded aperture (26) with the second component to be packaged (usually a concentrate, such as a concentrated acid). The first component preferably includes an indicator compound that changes colour in the presence of the second component, hereby indicating when the first and second components have been mixed. The flexible tube (19) is then inserted into the capsule (6) until the flange (20) rests on the lip of the threaded aperture (26). The capsule closure cap (23) is then screwed down over threaded aperture (26). The capsule (6) is introduced into the container (2) by snap fitting the notches (9) on the flexible fins (8) of the capsule (6) to the flange (10) extending around the inside of the neck of the container (2). Insertion of the capsule is achieved by compressing the flexible fins (8), and is assisted by the bevelled lower edge (17) of the fins. The flexible fins spring outwards to form a secure snap fit with the annular flange (10). Thereafter, it is very difficult to dislodge the capsule (6), but the upper part of the capsule can still be rotated about its longitudinal axis. The upper part of the capsule (6) extends into the threaded neck of the container (2), but there is still sufficient clearance between the upper part (7) of the capsule (6) and the inside of the threaded neck (3) to allow liquid to be poured out of the interior of the container (2) past the capsule (6) after the package has been opened.

Finally, closure cap (5) is screwed onto the threaded neck (3) to form a seal over the threaded neck (3) and around the nozzle (24). The drive pegs (15) on the closure cap and the ribs (16) on the upper part (7) of the capsule (6) make contact as the closure cap (5) is screwed down, but the drive pegs (15) can flex to pass over the ribs (16) so that little torsional force is applied to the upper part (7) of the capsule (6). The thread (12) joining the upper and lower parts of the capsule (6) is similarly handed to the thread on the threaded neck (3), whereby any torsional force exerted on the capsule (6) by the screwing on of cap (5) results only in tightening of thread (12).

Once the closure cap (5) has been screwed down fully, a tamper-evident break seal (not shown) is applied to the neck (3) of the container. The two-component package may then be stored indefinitely without mixing of the components.

Figure 3:
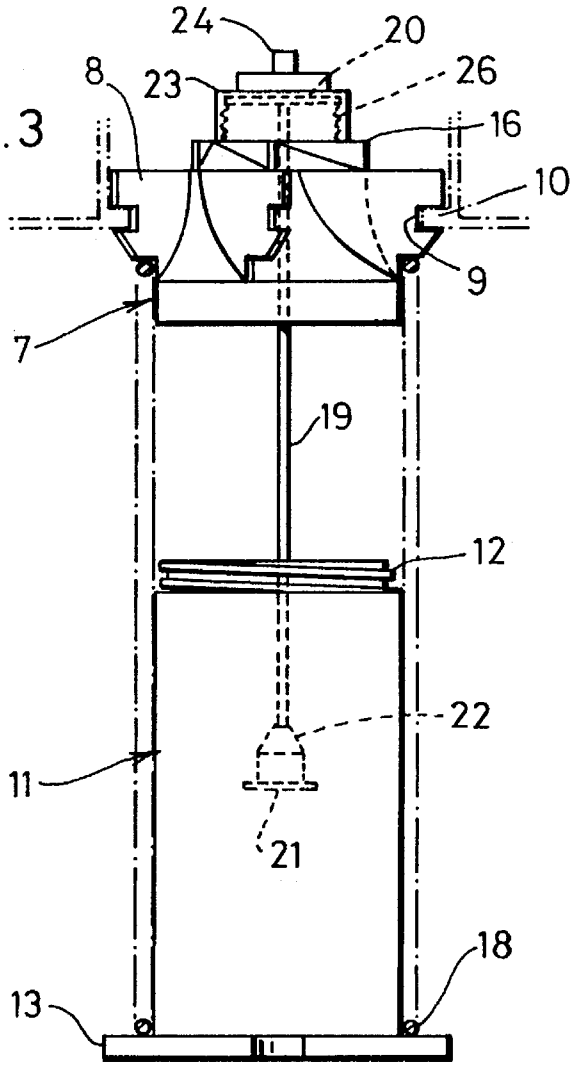
FIG. 3 shows a part-sectional elevation of part of the package of FIG. 1 illustrating the effect of opening the package.

The two-component package is opened as shown in FIG. 3. The closure cap (5) is simply unscrewed from the threaded neck (3) of the container (2). As the closure cap (5) is unscrewed, the drive pegs (15) on the closure cap (5) engage behind the ribs (16) on the upper part (7) of the capsule, whereby the said upper part (7) is rotated in the direction of rotation of the closure cap. The lower part (11) of the capsule (6) is blocked from rotation by the abutment between flange (13) on the capsule (6) and rib (14) on the container (2). The relative movement of the upper and lower parts of the capsule (6) unscrews the thread (12) joining the upper and lower parts together. The lower part (11) is then thrust away from the upper part (7) by the loaded coil spring (18), which results in rapid mixing of the contents of the capsule with the contents of the container.

The position of the screw thread (12) joining the upper and lower parts of the capsule (6) is selected so as to optimise mixing of the contents of the capsule with the contents of the container (2). Thus, if the capsule contains a liquid that is more dense than the liquid in the container (2), the screw thread (12) is preferably located lower down the capsule near the flange (13) at the bottom of the capsule. In other preferred embodiments, the coil spring (18) is dispensed with and the lower part (11) of the capsule (6) is made buoyant, so that, following release, it tips over on the surface of the liquid inside the container, thereby spilling its contents into the container.

In any case, complete mixing of the contents of the capsule (6) and the container (2) is generally achieved by screwing down the container closure cap (5) immediately following the release of the release means (12) by the initial unscrewing operation, followed by shaking the container to achieve complete mixing. This complete mixing is assisted if there is an air space left at the top of the container.

The diluent in the container preferably includes an indicator that changes colour in the presence of the contents of the capsule (6). A uniform colour change throughout the contents of the container (2) can thus be used as an indication that mixing is complete. For example, if the capsule contains a concentrated acid, then the diluent in the container preferably contains an acid/base indicator, such as litmus. If the capsule contains concentrated peroxide or peracetic acid solution, then the diluent in the container preferably contains a redox indicator.

Once mixing of the components is complete, the closure cap (3) may be removed completely prior to pouring out the mixture.

Figure 6:
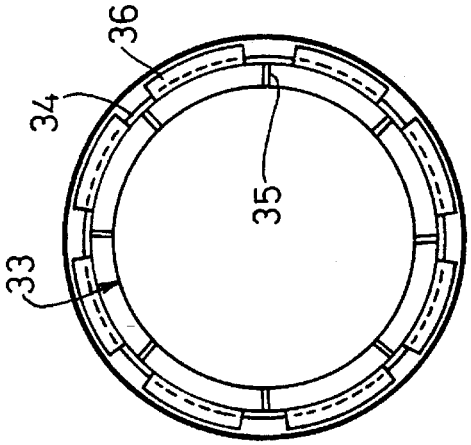
FIG. 6 shows a transverse cross-section through the embodiment of FIG. 4 along II—II.
Figure 5:
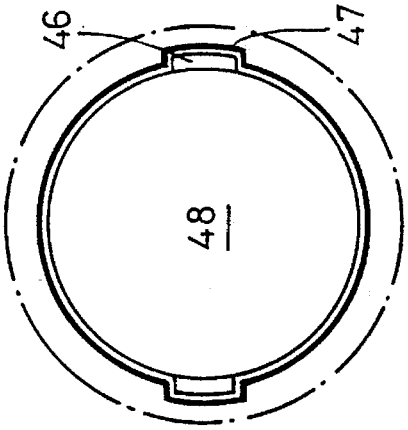
FIG. 5 shows a transverse cross-section through the embodiment of FIG. 4 along I—I.
Figure 4:
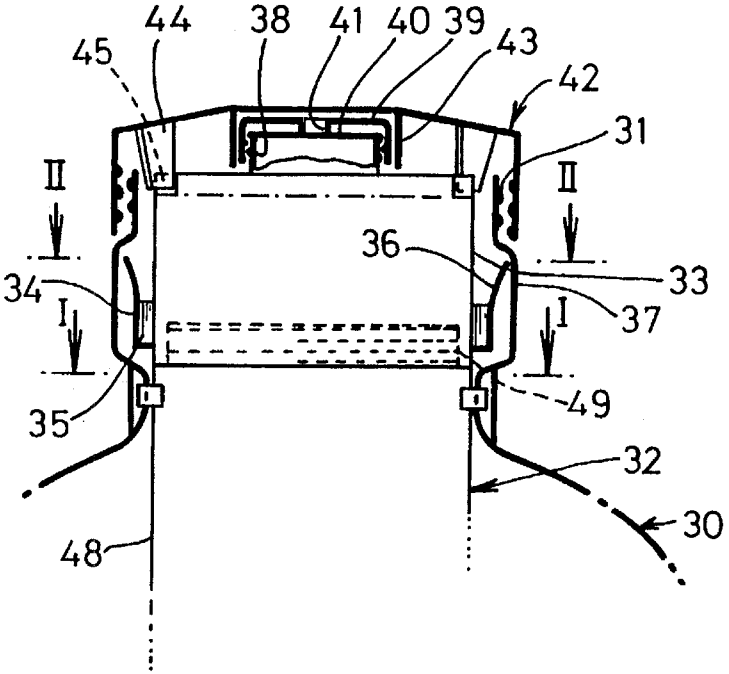
FIG. 4 shows a part-sectional elevation similar to FIG. 3, but illustrating an alternative embodiment of the present invention.

Referring now to FIGS. 4–6 of the accompanying drawings, an alternative embodiment of the mixing container according to the present invention comprises a container (30) having a threaded neck (31) and a capsule (32) inserted into the container (30). An upper part (33) of the capsule extends into the neck (31) of the container. A collar (34) extending around the upper part (33) of the capsule (32) is attached thereto by radial ribs (35) projecting from the capsule. A number of flexible fins (36) project upwardly from the collar (34). The capsule (32) is held in a longitudinally fixed position inside the container (30) by engagement of the collar (34) and flexible fins (36) in an annular recess (37) around the inside of the neck of the container (30).

At the top of the capsule (32) there is provided a threaded filling aperture (38), which is closed by a capsule closure cap (39). A hydrophobic semipermeable membrane (40) extends across the top of filling aperture (38) and is held in place by capsule closure cap (39). Excess gas from inside the capsule (32) can vent through the semipermeable membrane (40) and then through a small hole (41) in the base of the capsule closure cap (39).

A threaded closure cap (42) fits over the threaded neck (31) of the container (30) and forms a sealing engagement therewith. The capsule closure cap (39) fits into a hole in the base of the threaded closure cap (42). A lip (43) around the hole in the base of the threaded closure cap (42) forms an interference sealing fit with the side of the capsule closure cap (39).

A plurality of flexible drive pegs (44) of elongate cross-section project downwardly from the base of the threaded closure cap (42) to engage ratchet pegs (45) projecting upwardly from the upper part (33) of the capsule (32). The drive pegs (44) and ratchet pegs (45) are configured so that the threaded closure cap (42) can be screwed down with the drive pegs (44) riding over the ratchet pegs (45) without exerting substantial rotational force on the ratchet pegs (45), but unscrewing the threaded closure cap (42) causes the drive pegs to engage with the ratchet pegs (45) and rotate the uper part (33) of the capsule (32) in the direction of unscrewing.

Referring to FIG. 5, the lower part (48) of the capsule (32) is blocked from rotation by the engagement of tongues (46) projecting from the lower part (48) of the capsule (32) in a longitudinal groove (47) inside the neck (31) of container (30).

The lower part (48) and upper part (33) of the capsule are joined by screw thread (49). The screw thread (49) also functions as the release means for releasing the contents of the capsule when the threaded closure cap (42) is unscrewed. This is because the resulting rotation of the upper part (33) of the capsule (32), while the lower part (48) is held fixed, unscrews the screw thread (49).

This embodiment of the present invention is assembled in similar fashion to the embodiment of FIGS. 1–3. The filled and sealed capsule is inserted into the neck (31) of container (30). The flexible fins (36) flex inwardly to allow this insertion, and then snap outwardly to engage the annular recess (37). The threaded closure cap (42) is then screwed down over the threaded neck (41) of the container (30). The resulting two-component package can be stored indefinitely without mixing of the components stored in the container and the capsule.

The two-component package is opened as described above for the embodiment of FIGS. 1–3. Once again, it is preferable to screw the threaded closure cap (42) back down again immediately after opening and shake the container (30) to ensure complete mixing of the components from the capsule (32) and the container (30).

The two-component packages described above provide for indefinite storage of two components that must be stored separately but mixed immediately before use. Normally, the capsules contain a concentrate, such as a concentrated acid, and the containers receive a diluent, such as a hypochlorite solution. Since the capsules are entirely enclosed by the containers, the failure of the capsules will not result in leakage of concentrate outside the packages. Moreover, the closure caps cannot be unscrewed without releasing the concentrate into the diluent, thereby ensuring that the concentrate cannot separately be discharged into the environment. The packages are extremely simple to use, since the closure caps are unscrewed in the same way as for any other container.

Moreover, the two-component packages described above offer a number of practical advantages over existing two-component packages. One advantage is that the capsules are manufactured and filled entirely separately from the containers and the caps. This means that the shapes and materials of the capsules can be independently selected to minimise leakage of the contents of the capsules during storage. More complicated capsule shapes can be adopted without need for expensive manufacturing processes, since there is no need to mould the closure caps and any part of the capsules in one piece. Another advantage is that the closure caps do not come into direct contact with the concentrate inside capsules. This means that the caps, after they have been removed, will not bear potentially harmful traces of the concentrated component stored in the capsules. A further advantage is that the capsules can readily incorporate a gas venting means as described above.

It will be appreciated that the above embodiments have been described by way of example only. Many other embodiments falling within the scope of the accompanying claims will be apparent to the skilled reader.

We claim:

1. A two-component package for storing two components which are to be isolated from each other during storage and mixed when the package is opened, the package comprising:

a container to receive first component, said container having a threaded neck;

a threaded closure cap to close the threaded neck of the container;

a capsule to receive the second component, said capsule being located inside the container with an upper part of the capsule extending into the threaded neck of the container;

a first ratchet means extending inwardly from the closure cap;

a second ratchet means provided on the upper part of the capsule to engage said first ratchet means, whereby the closure cap can be screwed down without rotating the upper part of the capsule, but unscrewing the closure cap causes the top part of the capsule to rotate with the closure cap;

one or more rotation blocks provided on the outer wall of the capsule and on the inner wall of the container to impede rotation of the lower part of the capsule in the direction of unscrewing of the closure cap; and release means provided on the capsule to release the second component from the capsule when the upper part of the capsule is rotated relative to the lower part of the capsule.

2. A two-component package according to claim 1, wherein the capsule comprises snap-fitting means to secure the capsule to complementary receiving means on the inside of the container.

3. A two-component package according to claim 2, wherein the snap-fitting means comprises a plurality of radially compressible fins extending from the capsule.

4. A two-component package according to claim 2, wherein the complementary receiving means comprises a flange on the inside of the neck of the container.

5. A two-component package according to claim 2, wherein the complementary receiving means comprises an annular groove extending around the inside of the neck of the container.

6. A two-component package according to claim 1, wherein the first ratchet means comprises one or more drive pegs extending downwardly from the base to the closure cap and the second ratchet means comprises one or more ribs extending upwardly from the top part of the capsule, said drive pegs and/or said ribs being flexible.

7. A package according to claim 1, wherein the first ratchet means comprises a collar extending downwardly from the base of the closure cap with one or more first abutment means provided around the inner or outer circumference of the collar, and the second ratchet means comprises a cylinder on the top of the capsule, said cylinder fitting into or around the collar and being provided with one or more second abutment means around its outer or inner circumference, said first and/or said second abutment means being flexible.

8. A two-component package according to claim 1, wherein the rotation blocks comprise a flange on the lower part of the capsule and a rib on the inner wall of the container to abut against the flange.

9. A two-component package according to claim 1, wherein the rotation blocks comprise a tongue on the lower part of the capsule engaging a longitudinal groove in the inner wall of the container.

10. A two-component package according to claim 1, wherein the release means comprises a line of weakness formed in a wall of the capsule.

11. A two-component package according to claim 1, wherein the release means comprises a screw thread joining the upper and lower parts of the capsule.

12. A package according to claim 1, further comprising a loaded biasing means to push the upper and lower parts of the capsule apart after the release means has been released.

13. A two-component package according to claim 12, wherein the loaded biasing means comprises a coil spring substantially concentric with the longitudinal axis of the capsule.

14. A two-component package according to claim 1, wherein the capsule includes a gas venting means comprising an aperture covered by a semipermeable membrane.

15. A two-component package according to claim 14, wherein the aperture is at the end of a flexible tube extending into the capsule, the flexible tube being provided with flotation means.

16. A two-component package according to claim 15, wherein the flexible tube is branched and the aperture at the end of each branch is covered by a semipermeable membrane.

* * * * *